United States Patent [19]

Debenham et al.

[11] 3,980,034

[45] Sept. 14, 1976

[54] METHOD OF PRODUCING AN EASY-OPENING CLOSURE

[76] Inventors: Michael Debenham, "Winton" Humphries Road, Frankston, Victoria; Thomas Charles Coy, 4 Doset Court, Noble Park, Victoria, both of Australia

[22] Filed: May 14, 1974

[21] Appl. No.: 469,866

[30] Foreign Application Priority Data

May 15, 1973 Australia ..... 55705/73

[52] U.S. Cl. ..... 113/121 C

[51] Int. Cl.[2] ..... B21D 51/38

[58] Field of Search ..... 113/15 R, 15 A, 121 C

[56] References Cited

UNITED STATES PATENTS

| | | | |
|---|---|---|---|
| 625,055 | 5/1899 | Painter | 215/250 |
| 2,261,117 | 11/1941 | Jack, Jr. | 220/269 |
| 3,266,452 | 8/1966 | Taylor | 113/121 C |
| 3,472,415 | 10/1969 | Woodruff | 220/277 |
| 3,759,206 | 9/1973 | Dalli et al. | 113/121 C |
| 3,760,752 | 9/1973 | Geiger | 113/121 C |

*Primary Examiner*—C.W. Lanham
*Assistant Examiner*—Gene P. Crosby
*Attorney, Agent, or Firm*—Murray and Whisenhunt

[57] ABSTRACT

This specification discloses a method of forming an easy-opening closure of the type wherein there is overlap between the closure member and the surrounding container member comprising forming a bulge in the hinge area of the closure and subsequently flattening this bulge to achieve displacement of the closure member into overlapping relationship with the surrounding container member. The closure member must have a non-diverging configuration extending away from the hinge member, for example, triangular or semi-circular configurations.

12 Claims, 5 Drawing Figures

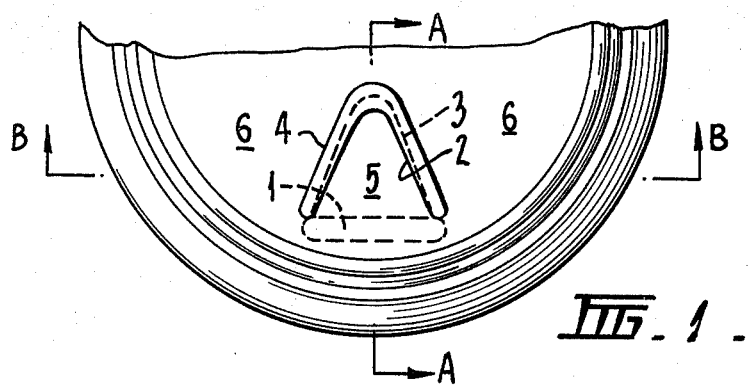
FIG. 1.
FIG. 2.
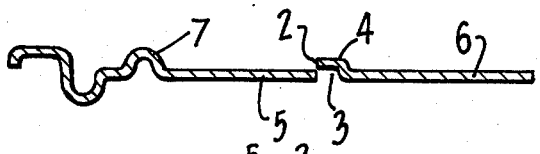
FIG. 3.
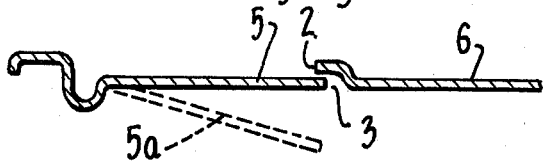
FIG. 4.
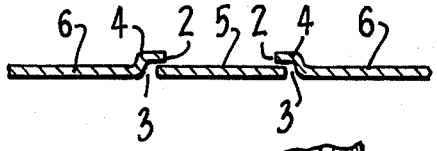
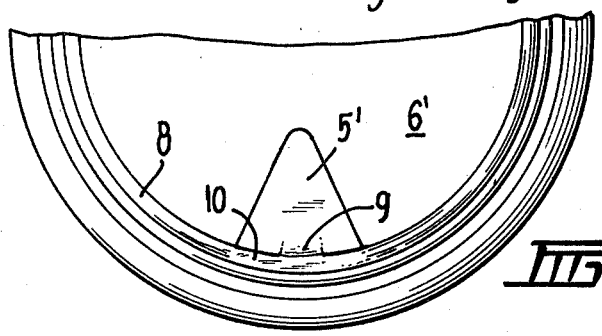
FIG. 5.

METHOD OF PRODUCING AN EASY-OPENING CLOSURE

This invention relates to push-in easy-opening closures.

U.S. Pat. No. 3,759,206 discloses two forms of push-in easy-opening closures wherein an overlapping relationship between a push-in closure and the surrounding metal is achieved by at least partially flattening a bulge in the surround to reduce the size of the closure opening. The bulge is formed prior to severance of the push-in closure from the sheet metal container member.

The object of the present invention is to achieve the necessary overlap in a different way.

The present invention in one form involves forming a bulge at least near that portion of the sheet metal container member where the push-in closure hinge will be.

By forming a bulge at least near the area at which the closure connection or hinge will be located, thereafter severing the sheet metal to form a closure member, with substantially all of the severing being outside of the bulge, and then flattening the bulge at said area, the closure will be displaced in a direction away from the hinge, thus forming an overlap with the surrounding sheet metal without substantially changing the size of the closure. The bulge which is to be flattened should lie at least partially and preferably substantially outside of the closure per se, although a portion of the bulge may extend to the closure. The bulging and severing and flattening operations will be similar, other than as described above, to the corresponding applications in the above identified U.S. patent.

The invention is also applicable to cold working operations, other than bulging and flattening, which result in displacement of the closure.

The bulge may form part of a continuous raised portion formed in a can end or similar container member. This raised portion may be similar to an expansion ring in a typical can end and may be formed in the initial end blanking end forming operation. The raised portion is flattened in the region of the hinge member to achieve the necessary displacement of the closure.

Two preferred forms of push-in closure are described in relation to the accompanying drawings wherein:

FIG. 1 is a fragmentary top view of a push-in easy-opening closure can or container lid;

FIG. 2 is a fragmentary cross-section of the lid of FIG. 1, taken along lines A—A, during the process for producing the can top of FIG. 1, before the bulge flattening step;

FIG. 3 is a fragmentary cross-sectional view of the can or container end of FIG. 1, similar to FIG. 2, but after the bulge flattening step, wherein overlap of the closure and the surrounding area has been obtained;

FIG. 4 is a fragmentary cross-sectional view of the container or can lid of FIG. 1, taken along lines B—B after the bulge flattening step, and FIG. 5 is a fragmentary top view of a can end having an alternative form of closure.

In FIG. 1, a partial view of a container lid or can lid of steel, aluminum or any other suitable sheet metal having a push-in easy-opening closure is illustrated. An area 1 of the can lid, which had been bulged, is represented in its flattened condition. Immediately adjacent the bulged area is the easy-opening tab 5, having a free edge 3. The can end 6 contains an upstanding or lip portion 4 having a free edge 2.

The process of producing the easy-opening push-in closure of FIG. 1 is illustrated in greater detail in FIGS. 2, 3 and 4. In FIG. 2, the cross-sectional view of the can or container lid of FIG. 1 is illustrated, at an intermediate step in the production thereof. A bulge 7 is formed in area 1, which is the connecting or hinge area between tab or closure 5 and lid 6. Tab or closure 5 is separated from can lid 6 by severing to provide closure free-edge 3 and surround free-edge 2. At the same time or before the severing operation is conducted, a shoulder 4 may be formed on the area surrounding the closure opening.

FIG. 3 represents the next step in the production of the push-in closure. Bulge 7 has been flattened in a later operation, causing lateral movement of free-edge 3 to provide an overlapping relationship of the free-edge 3 and shoulder 4. The application of finger pressure to closure 5 results in displacement of the tab to the dotted portion shown as 5*a*, allowing the container contents to be poured or otherwise removed from the container.

FIG. 4 is a partial cross-sectional view of the can lid and closure of FIG. 1, illustrating the same step in the closure manufacturing process as FIG. 3, that is, after the bulge in the hinge area has been flattened. Because of the triangular or wedge-shaped nature of container closure 5, an overlapping relationship is established between free edges 3 and shoulders 4.

Of course, other closure member free-edge configurations may be used, ranging from semicircular to wedge-shaped, as long as the sides of closure member 5 are not diverging from the hinge area.

The application of sealant to the cut edges would result in a container which is suitable for use in containing liquids, including beer, and other malt liquors or carbonated beverages, or other pressurized liquids. This technique is also applicable for forming closures for vacuum-packaging of products.

In some instances, a closure member having parallel sides may be used, in which case the only overlap is on the end of the closure removed from the hinge area. The use of a sealant of adequate strength permits such a design to contain pressurized beverages, or if desired, such a design may be used as a sift-proof closure.

In the alternative preferred form shown in FIG. 5, the lid or end 6' is formed with a continuous raised rib 8 which is most conveniently formed in the lid stamping process. The lid is severed to define a closure tab 5' connected to the lid at 9, which is closely adjacent the rib 8. The severing of the lid is substantially as before but the connecting portion 9 is narrower by virtue of the sever extending along the edge of the rib 8.

The rib 8 is flattened in the area 10 near the connecting or hinge area 9 to displace the tab 5' and produce overlap between the tab 5' and the surrounding metal of the end 6'.

Sealant is applied to the closure tab edges and to the sever line adjacent the rib 8 as in the previous embodiment.

It will be appreciated that the rib 8 may be formed with a smaller diameter with the closure or closures extending outwardly of the rib rather than inwardly. Similarly, the connecting portion 9 may extend for the full width of the closure rather than only part of it.

It will also be appreciated that while we have disclosed bulging and flattening as the means for achieving displacement of the closure, other cold working operations such as stretching or scoring may be used to achieve displacement of the closure without substantial change to its size or shape.

We claim:

1. A method of forming an easy-opening closure in a sheet metal container member, said method consisting essentially of forming a bulge in an area of the sheet metal container member, partially severing a portion of the sheet metal adjacent said area to provide a free-edge which loops from adjacent a first point along the bulge to a second point along the bulge without diverging width wise between these points, the bulge lying outside of the loop, the free edge of the sheet metal from which said portion is partially severed defining an opening, and said severed portion defining a closure member for said opening, thereafter increasing the size of the closure member by at least partly flattening at least that portion of said bulge lying between said points to place at least a part of the free-edge portion of said closure member and the free-edge defining said opening or the interior surface of the sheet metal adjacent said opening in overlapping contact or in overlapping close proximity, whereby said container member having said-easy opening closure is suitable for use in forming a container for liquids.

2. A method of forming an easy-opening closure in a sheet metal container member, said method consisting essentially of forming an elongated bulge in an area of said metal container member, partially severing a portion of the sheet metal adjacent said area to provide a looping free-edge which defines an opening outside the loop and a non-diverging tongue-shaped closure member inside the loop, the looping free-edge being generally outside said bulge, but ending at spaced points along the length of the bulge, the area of the sheet metal between the spaced points serving as a hinge for the closure member, thereafter at least partially flattening the bulge at least between said spaced points to displace the tongue-shaped closure member bodily in the direction which proceeds from the root of the tongue-shaped closure member toward the opposite end thereof to place at least a part of the free-edge portion of the closure member and the free-edge defining the opening, or the interior surface of the sheet metal adjacent said opening, in overlapping contact or in overlapping close proximity.

3. A method of forming an easy-opening closure in a sheet metal container member, said method consisting essentially of forming an elongated bulge in an area of the sheet metal container member, partially severing a tongue-shaped portion of the sheet metal adjacent said area to provide a looping free-edge which defines an opening outside the loop, the free-edge having opposite ends at two points spaced from one another along the length of the bulge, so that the bulge extends widthwise with respect to the tongue-shaped closure member adjacent the root of the tongue-shaped closure member, and outside of said closure member, the tongue-shaped closure member being of maximum width at the root thereof, thereafter increasing the length of the closure member by at least partially flattening said bulge adjacent said root to move the tongue-shaped closure member bodily in the direction which proceeds from the root of the tongue-shaped closure member toward the opposite end thereof to place at least a part of the free-edge portion of the closure member and the free-edge defining the opening, or the interior surface of the sheet metal adjacent said opening, in overlapping contact or in overlapping close proximity.

4. A method of forming an easy-opening closure of the push-in type in a sheet metal container member, consisting essentially of forming a bulge in an area of the container member: thereafter partially severing a portion of the sheet metal to provide a free-edge and an unsevered area connecting the severed portion to the remainder of the container member, wherein the bulge lies outside of the severed portion and adjacent the unsevered area, the free-edge of the container member from which said portion is partially severed defining an opening, and said severed portion defining a closure member for said opening, said closure member being of non-diverging configuration extending away from the unsevered area; and thereafter displacing the closure member towards the free-edge opposite the unsevered area without substantially changing the size of said opening or the shape of said closure member by at least partially flattening at least that portion of the bulge lying outside the severed area and adjacent the unsevered area, to place at least a part of the free-edge defining the opening or the surface of the sheet metal adjacent said opening and the free-edge of the closure member in overlapping contact or in overlapping close proximity.

5. Method of claim 4, wherein the container member is a beverage can end.

6. Method of claim 5, further comprising the step of forming a seat in the sheet metal adjacent said opening, and displacing the closure member into the seat.

7. Method of claim 5, wherein said sheet metal is steel.

8. Method of claim 5, wherein said sheet metal is aluminum

9. Method of claim 5, including the additional step of applying a sealant to the region of overlap after the closure member is displaced.

10. Method of claim 5, wherein the closure member is displaced in substantially the same plane as the container member.

11. Method of claim 5, wherein the bulge forms part of an annular ring formed in the container member.

12. Method of claim 11, wherein the closure member is located inside said annular ring.

* * * * *